US006846620B1

(12) United States Patent
Mura, Jr. et al.

(10) Patent No.: US 6,846,620 B1
(45) Date of Patent: Jan. 25, 2005

(54) PHOTOGRAPHIC ELEMENT WITH DYE-FORMING COUPLER AND IMAGE DYE STABILIZING COUPLER SOLVENT

(76) Inventors: Albert J. Mura, Jr., Eastman Kodak Company, 343 State St., Rochester, NY (US) 14650; Gary M. Russo, Eastman Kodak Company, 343 State St., Rochester, NY (US) 14650; J. Ramon Vargas, Eastman Kodak Company, 343 State St., Rochester, NY (US) 14650; Shari L. Eiff, Eastman Kodak Company, 343 State St., Rochester, NY (US) 14650

( * ) Notice: Subject to any disclaimer, the term of this patent is extended or adjusted under 35 U.S.C. 154(b) by 0 days.

(21) Appl. No.: 10/609,056

(22) Filed: Jun. 27, 2003

(51) Int. Cl.[7] ..... G03C 7/388; G03C 7/392; G03C 7/36

(52) U.S. Cl. ..... 430/546; 430/551

(58) Field of Search ..... 430/546, 551

(56) References Cited

U.S. PATENT DOCUMENTS

| | | | | |
|---|---|---|---|---|
| 4,749,645 A | | 6/1988 | Goddard et al. | |
| 4,782,011 A | | 11/1988 | Goddard et al. | |
| 5,028,519 A | * | 7/1991 | Morigaki et al. | 430/551 |
| 5,091,294 A | | 2/1992 | Nishijima et al. | |
| 5,188,926 A | | 2/1993 | Schofield et al. | |
| 5,192,646 A | | 3/1993 | Merkel et al. | |
| 5,284,742 A | | 2/1994 | Yamazaki et al. | |
| 5,294,530 A | | 3/1994 | Seto et al. | |
| 5,352,572 A | | 10/1994 | Seto et al. | |
| 5,426,021 A | | 6/1995 | Krishnamurthy et al. | |
| 5,441,855 A | | 8/1995 | Weber et al. | |
| 5,441,861 A | | 8/1995 | Weber et al. | |
| 5,466,569 A | | 11/1995 | Weber et al. | |
| 5,478,713 A | * | 12/1995 | Nobuo et al. | 430/551 |
| 5,567,578 A | | 10/1996 | Makuta et al. | |
| 5,891,613 A | | 4/1999 | Zengerle et al. | |
| 5,935,773 A | | 8/1999 | Hagemann et al. | |
| 6,045,987 A | | 4/2000 | Shimada et al. | |
| 6,413,707 B1 | | 7/2002 | Schroeder et al. | |
| 6,555,305 B1 | | 4/2003 | Vargas et al. | |
| 6,555,306 B1 | | 4/2003 | Vargas et al. | |

FOREIGN PATENT DOCUMENTS

| | | |
|---|---|---|
| DE | 4307439 | 9/1994 |
| DE | 4320828 | 1/1995 |
| DE | 19632927 | 2/1998 |
| EP | 310 551 | 4/1989 |
| EP | 310 552 | 4/1989 |
| EP | 538 862 | 4/1993 |
| EP | 1 116 997 | 7/2001 |
| GB | 1267287 | 3/1972 |
| WO | 91/08515 | 6/1991 |

* cited by examiner

*Primary Examiner*—Richard L. Schilling
(74) *Attorney, Agent, or Firm*—Andrew J. Anderson

(57) ABSTRACT

Photographic elements are disclosed comprising a silver halide emulsion layer having associated therewith a dye forming coupler and a compound of the following Formula I:

$$R^1R^2N—C(O)—(R)_p—C(O)—NR^3R^4$$

wherein R represents a hydrocarbon linking group; p=0 or 1; and each of $R^1$, $R^2$, $R^3$ and $R^4$ independently represents an aromatic, cyclic, linear or branched chain hydrocarbon group, or $R^1$ and $R^2$ or $R^3$ and $R^4$ combine together to form a ring with the associated nitrogen atom to which they are attached; with the proviso (i) at least one of $R^1$, $R^2$, $R^3$ and $R^4$ comprises an aromatic, cyclic, secondary alkyl, or otherwise or branched hydrocarbon group, or (ii) at least $R^1$ and $R^2$ or $R^3$ and $R^4$ combine together to form a ring with the associated nitrogen atom. Photographic elements of the present invention upon exposure and photographic processing exhibit good activity and yield dye images that have unexpected and substantial improvements in the stability of the formed image dyes.

19 Claims, No Drawings

PHOTOGRAPHIC ELEMENT WITH DYE-FORMING COUPLER AND IMAGE DYE STABILIZING COUPLER SOLVENT

FIELD OF INVENTION

This invention relates to silver halide color photographic materials. More particularly, it relates to color photographic materials which contain dye-forming couplers in combination with non-imaging compounds which function as coupler solvents and which give rise to photographic images which have high stability towards fading by light.

BACKGROUND OF THE INVENTION

In a silver halide photographic element, a color image is formed when the element is exposed to light and then subjected to color development with a primary aromatic amine developer. Color development results in imagewise reduction of silver halide and production of oxidized developer. Oxidized developer reacts with one or more incorporated dye-forming couplers to form an imagewise distribution of dye. Dye-forming couplers (as well as other various photographic addenda) are typically dispersed in silver halide emulsion layers of the photographic element with the aid of coupler solvents, which are typically oily or low melting compounds.

In any polychromatic chromogenic photographic material it is desirable that the dyes so formed should have certain properties. For instance, the dyes should be bright in color with very little secondary absorption so that good color reproducibility is obtained. The stability of image dyes generated on chromogenic development often does not meet performance expectations. These expectations include resistance to light fade and both humid and dry heat dark fade. The dyes that are formed by any color coupler during processing have a tendency to fade over time as a result of exposure to light, heat, humidity and oxygen resulting in a deterioration of the original recorded image. It is therefore highly desirable that the formed dyes should be resistant towards fading by heat, humidity and light.

Techniques are known in the art for providing resistance to light fade of photographic dyes. Compounds which have been disclosed as light stabilizers for yellow image dyes, e.g., include substituted phenolic and blocked phenolic compounds including; heterocyclic phosphorous materials (U.S. Pat. No. 4,749,645), phenolic thiane derivatives (EP 0 310 551), substituted and blocked bisphenols (UK 1,267, 287, U.S. Pat. No. 4,782,011, DE 4,307,439, DE 4,307,439, DE 4,320,828, EP 0 508 398, EP 0 538 862, U.S. Pat. No. 5,294,530, U.S. Pat. No. 5,426,021, U.S. Pat. No. 5,441,855, U.S. Pat. No. 5,441,861, U.S. Pat. No. 5,466,569, U.S. Pat. No. 5,891,613, WO 91/008,515, U.S. Pat. No. 5,567,578, U.S. Pat. Nos. 5,284,742, 5,091,294, EP 0 310 552, U.S. Pat. No. 5,935,773). In addition, yellow dyes may also be stabilized against fading by light with the use of thiomorpholine dioxide compounds as described in EP 1 116 99. However, it is desirable to improve on the light stabilization of dyes beyond that afforded with use of the above stabilizers.

German patent application DE 1 96 32927 describes the use of cyclic imides, cyclic carbamates, and cyclic ureas as a means of improving the chromogenically developed color image dye stabilities. However, in particular, the amount of dye stabilization to light fade is only modest. U.S. Pat. No. 5,352,572 reports the use of a specific bis-urea compound in combination with malonamide yellow couplers. However, the bis-urea was not shown to be effective for other couplers and was specifically reported to be ineffective for beta-ketoamide yellow couplers. U.S. Pat. No. 6,045,987 describes the use of amide group substituted aromatic compounds, wherein the amide groups are directly bonded to a phenyl ring, as addenda to coupler dispersions, and in particular the use of such compounds in association with magenta and cyan dye image-forming couplers. Essentially equivalent results are reported for the use of such amide group substituted phenyl compounds regardless of whether the amide group substituents comprise normal, cyclic, or branched alkyl groups.

U.S. Pat. No. 6,413,707 discloses the use of urethane compounds and U.S. Pat. No. 6,555,306 describes employing a substituted dipiperidine compound as coupler solvents in photographic elements to improve image dye stability. While effective, many of such compounds are relatively expensive. Due to the amount of coupler solvent typically required for coating dye-forming couplers as well as other addenda typically associated therewith (such as additional image dye stabilizing compounds), it is desirable that solvents employed be of relatively low cost. Additionally, it would be desirable if the solvent employed also enhanced stability of the formed dye images, such that lower amounts of additional stabilizer compounds would need to be employed to provide desired results.

SUMMARY OF THE INVENTION

An objective of this invention is to provide photographic elements which exhibit desired image dye stability. In accordance with the invention, a photographic element is disclosed comprising a silver halide emulsion layer having associated therewith a dye forming coupler and a compound of the following Formula I:

$$R^1R^2N—C(O)—(R)_p—C(O)NR^1R^4$$

wherein R represents a non-aromatic hydrocarbon linking group; p=0 or 1; and each of $R^1$, $R^2$, $R^3$ and $R^4$ independently represents an aromatic, cyclic, linear or branched chain hydrocarbon group, or $R^1$ and $R^2$ or $R^3$ and $R^4$ combine together to form a ring with the associated nitrogen atom to which they are attached; with the proviso (i) at least one of $R^1$, $R^2$, $R^3$ and $R^4$ comprises an aromatic, cyclic, secondary alkyl, or otherwise branched hydrocarbon group, or (ii) at least $R^1$ and $R^2$ or $R^3$ and $R^4$ combine together to form a ring with the associated nitrogen atom.

We have found that the objective of the invention of providing photographic elements which exhibit desired image dye stability for dyes formed from couplers can be achieved through the use of compounds of Formula I in combination with image forming couplers. In accordance with preferred embodiments of the invention, such compounds may be used in combination with yellow dye-forming couplers, particularly in combination with substituted phenolic and/or thiomorpholine dioxide stabilizers. In addition to stabilizing properties, compounds of Formula I have organic solvent properties, and accordingly may be advantageously used partly or totally in place of conventional high boiling permanent and/or auxiliary organic coupler solvents to disperse the dye-forming couplers. Photographic elements of the present invention upon exposure and photographic processing exhibit good activity and yield dye images that have unexpected and substantial improvements in the stability of the formed image dyes.

DETAILED DESCRIPTION OF THE INVENTION

The photographic elements of this invention can be chromogenic black and white elements (for example, using yellow, magenta and cyan dye forming couplers), single color elements or multicolor elements. In accordance with preferred embodiments of the invention, the photographic elements comprise at least one yellow dye image forming layer, at least one cyan dye image forming layer and at least one magenta dye image forming layer. More particularly, multicolor photographic elements in accordance with preferred embodiments of the invention preferably comprise a support bearing light sensitive image dye forming layers sensitized to the blue (approx. 380–500 nm), green (approx. 500–600 mm), and red (approx. 600–760 nm) regions of the electromagnetic spectrum. In accordance with a preferred embodiment of the invention, the element comprises cyan, magenta and yellow dye forming silver halide emulsion hydrophilic colloid layer units sensitized to the red, green and blue regions of the spectrum. Each unit can comprise a single emulsion layer or multiple emulsion layers sensitive to a given region of the spectrum. The layers of the element, including the layers of the image forming units, can be arranged in various orders as known in the art. It is within the scope of this invention, however, for the light sensitive material to alternatively or additionally be sensitive to one or more regions of the electromagnetic spectrum outside the visible, such as the infrared region of the spectrum. In most color photographic systems, non-diffusing color-forming couplers are incorporated in the light-sensitive photographic emulsion layers so that during development, they are available in the emulsion layer to react with the color developing agent that is oxidized by silver halide image development. When the dye image formed is to be used in situ, couplers are selected which form non-diffusing dyes. Color photographic systems can also be used to produce black-and-white images from non-diffusing couplers as described, e.g., by Edwards, et al., in International Publication No. WO 93/012465.

Throughout this application a reference to any type of chemical "group" includes both the unsubstituted and substituted forms of the group described. Generally, unless otherwise specifically stated, substituent groups usable on molecules herein include any groups, whether substituted or unsubstituted, which do not destroy properties necessary for the photographic utility. It will also be understood throughout this application that reference to a compound of a particular general formula includes those compounds of other more specific formula which specific formula falls within the general formula definition. Examples of substituents on any of the mentioned groups can include known substituents, such as: halogen, for example, chloro, fluoro, bromo, iodo; alkoxy, particularly those with 1 to 6 carbon atoms (for example, methoxy, ethoxy); substituted or unsubstituted alkyl, particularly lower alkyl (for example, methyl, trifluoromethyl); alkenyl or thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); and others known in the art. Alkyl substituents may specifically include "lower alkyl", that is having from 1 to 6 carbon atoms, for example, methyl, ethyl, and the like. Further, with regard to any alkyl group, alkylene group or alkenyl group, it will be understood that these can be branched or unbranched and include ring structures.

Compounds of Formula I which are employed as dye image stabilizing compounds and/or solvents in photographic elements in combination with dye forming couplers in accordance with the present invention may be prepared according to synthetic methods known in the art. Hydrocarbon linking groups represented by R may comprise, e.g., further substituted or unsubstituted cyclic, linear, or branched chain non-aromatic linking groups, and when present (i.e., when p. 1) preferably comprises from 1 to 30 carbon atoms, more preferably from 6 to 22 carbon atoms. The term "non-aromatic linking group" is used in the present invention to designate the presence of a linking group R such that the $R^1R^2N$—C(O)— and the —C(O)—$NR^3R^4$ groups are not bonded directly to an aromatic ring (such as a phenyl ring). Representative examples of non-aromatic hydrocarbon linking groups include: $C_1$–$C_{30}$ alkylene, tetramethylhexane, cylcohexane, cyclohexane di ethyl, dioxaoctane, p-phenylene-di-propane, and the like. In a particularly preferred embodiment, R may represent a saturated or unsaturated $C_1$–$C_{16}$ alkylene linking group. Non-aromatic hydrocarbon linking groups represented by R may be further substituted or unsubstituted, with aromatic or non-aromatic substituents, so long as the $R^1R^2N$—C(O)— and the —C(O)—$NR^3R^4$ groups are not bonded directly to an aromatic ring. In a particular embodiment, e.g., hydrocarbon linking groups represented by R may comprise one or more substituents comprising additional —C(O)—$NR^1R^2$ type amide groups.

Each of $R^1$, $R^2$, $R^3$ and $R^4$ in Formula I may comprise aromatic, cyclic, linear, or branched chained hydrocarbon groups, which may be the same or different, or $R^1$ and $R^2$ or $R^3$ and $R^4$ may combine together to form a ring with the associated nitrogen atom to which they are attached, provided (i) at least one of $R^1$, $R^2$, $R^3$ and $R^4$ comprises an aromatic, cyclic, secondary alkyl, or otherwise or branched hydrocarbon group, or (ii) at least $R^1$ and $R^2$ or $R^3$ and $R^4$ combine together to form a ring with the associated nitrogen atom (such as, e.g., a piperidine or morpholine group). In preferred embodiments, $R^3$ and $R^4$ are selected to match $R^1$ and $R^2$, as symmetrical compounds are preferred for ease of synthesis. Subject to the above proviso, each of $R^1$, $R^2$, $R^3$ and $R^4$ preferably comprises from 1 to 22 carbon atoms, more preferably from 2 to 14 carbon atoms and most preferably from 3 to 10 carbon atoms. Also preferred is that at least two, and more preferably each of $R^1$, $R^2$, $R^3$ and $R^4$, comprise cyclic, secondary, or otherwise branched chain alkyl groups, or that both $R^1$ and $R^2$ as well as $R^3$ and $R^4$ combine to form rings with their associated nitrogen atoms. Representative examples for $R^1$, $R^2$, $R^3$ and $R^4$ groups include: methyl, ethyl, propyl, iso-propyl, butyl, iso-butyl, pentyl, hexyl, ethylhexyl, octyl, nonyl, iso-nonyl, decyl, iso-decyl, undecyl, dodecyl, tridecyl, tetradecyl, myristyl, pentadecyl, cetyl, stearyl, arachidyl, behenyl, undecylenyl, palmitoleyl, oleyl, linoleyl, linolenyl, arachidonyl, erucyl, benzyl, cyclohexyl, phenoxyethyl, and phenyl. R1 and R2 or R3 and R4 may combine, e.g., to form hexamethylene, heptamethylene, pentamethylene, methylpentamethylene and dimethylpentamethylene groups, which form a ring with the associated nitrogen atom. This list is non exhaustive and may also include numerous other linear, branched chain, cyclic, or aromatic hydrocarbon groups. Use of compounds in accordance with the invention have been found to provide surprisingly superior results relative to use of otherwise similar compounds when R represents a non-aromatic linking group but where the proviso is not satisfied (e.g., where each of $R^1$, $R^2$, $R^3$ and $R^4$ comprise n-alkyl groups).

Specific examples of compounds of Formula I include, but are not limited to, the following:

Ia
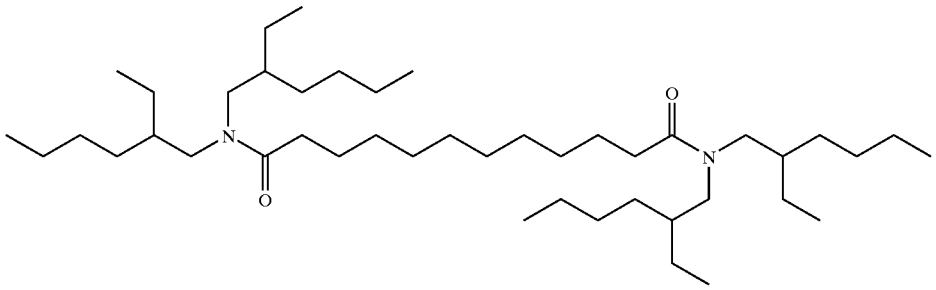
Ib
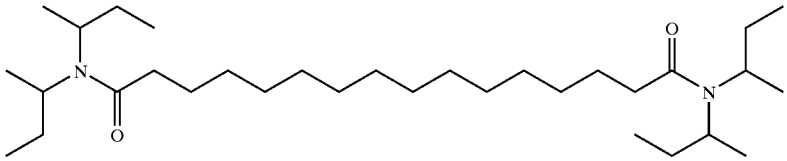
Ic
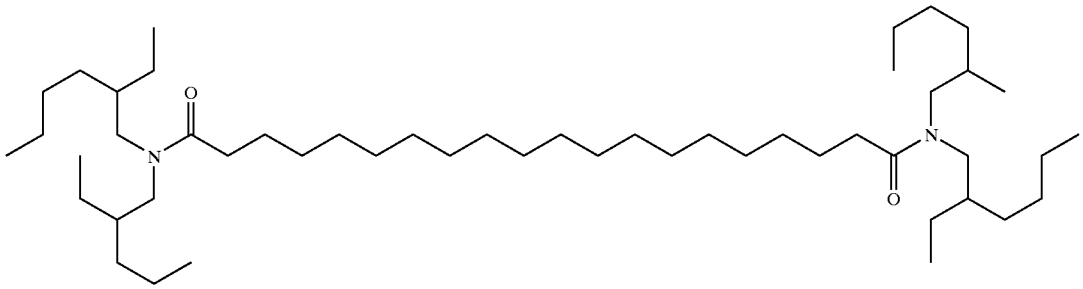
Id
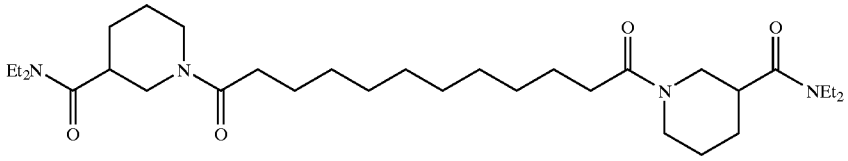
Ie
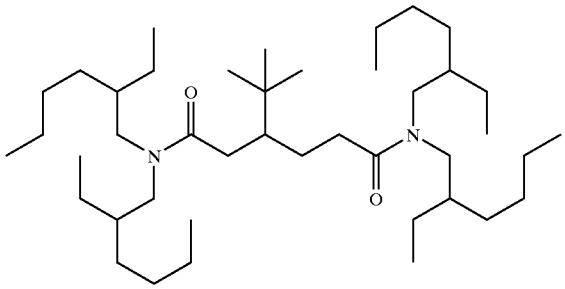
If
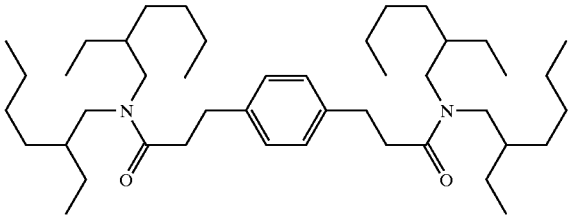
Ig
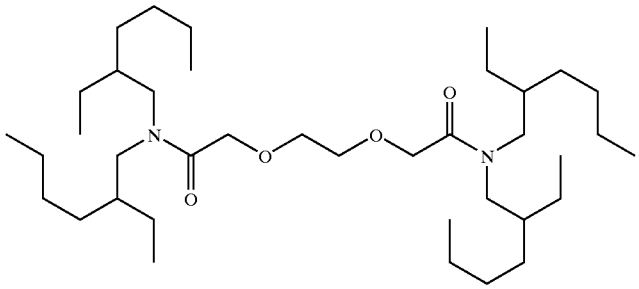

-continued
Ih
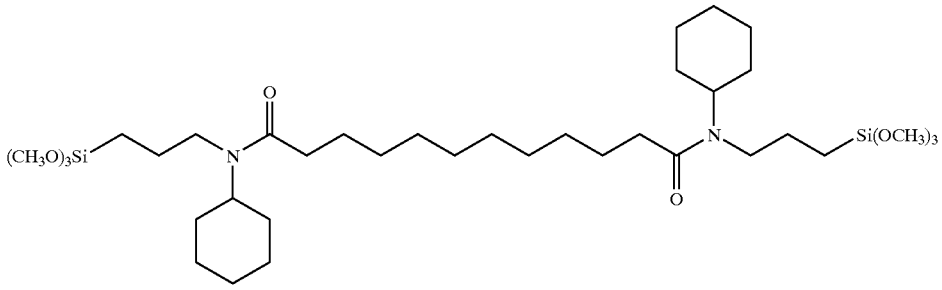
Ii
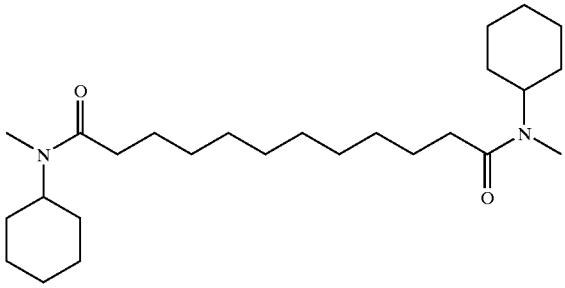
Ij
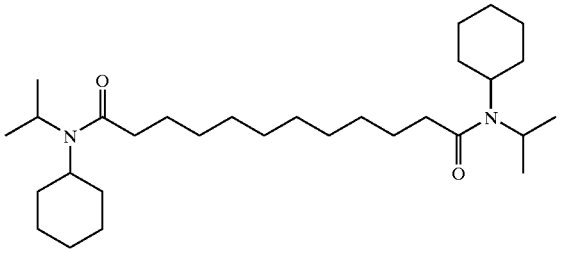
Ik
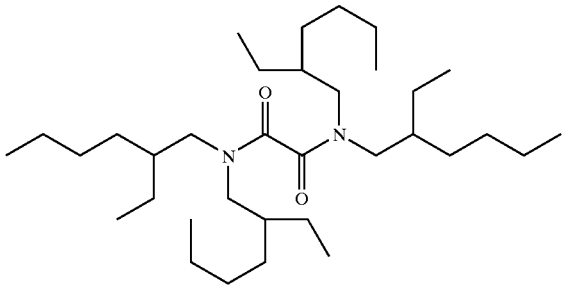
Il
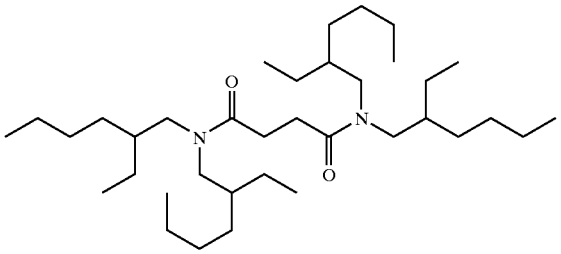
Im
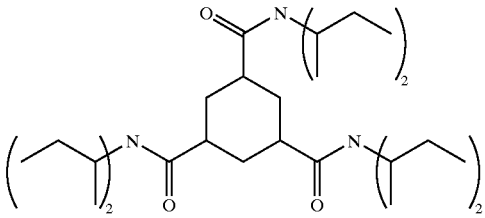
In
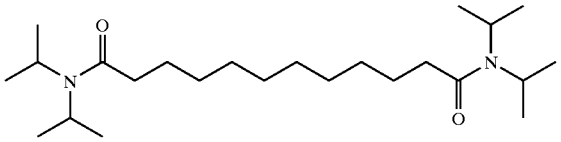
Io
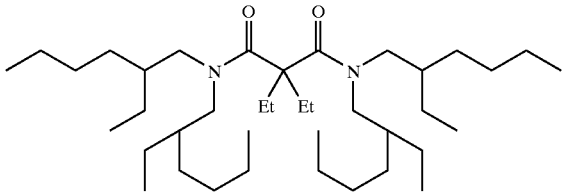
Ip
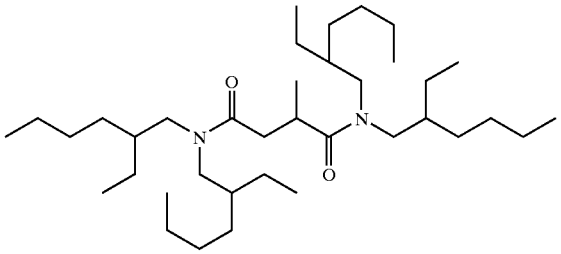

-continued
Iq
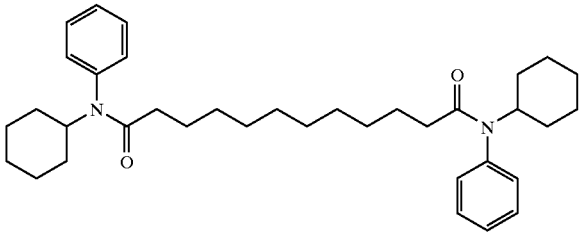
Ir
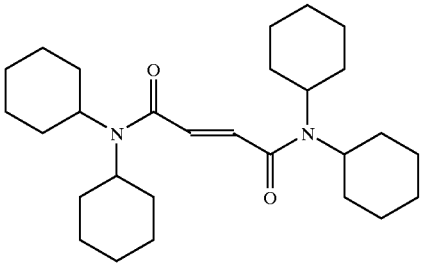
Is
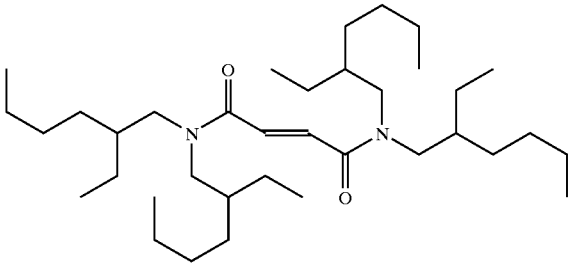
It
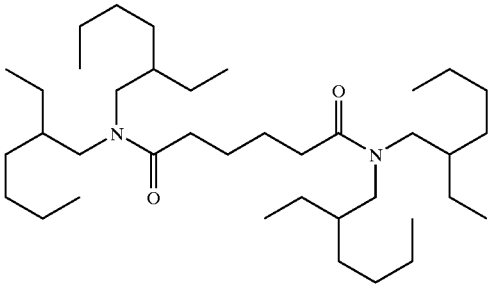
Iu
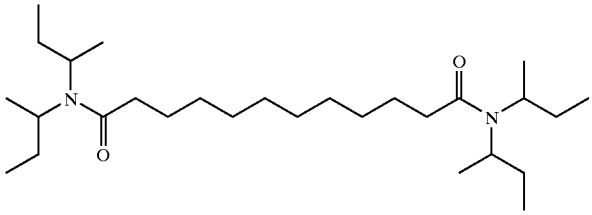
Iv
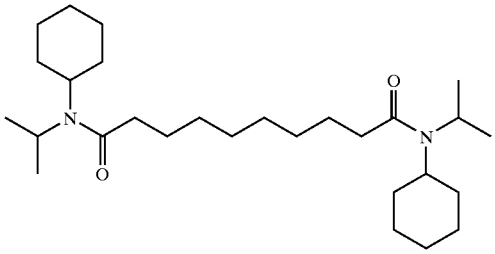
Iw
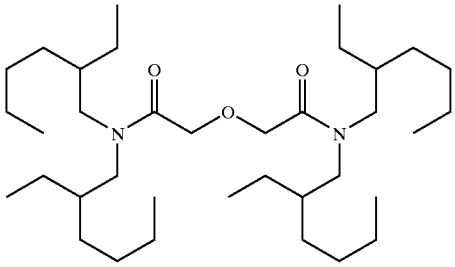
Ix
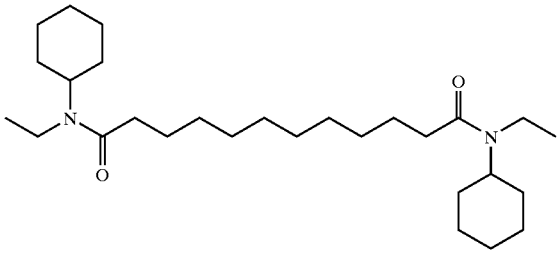
Iy
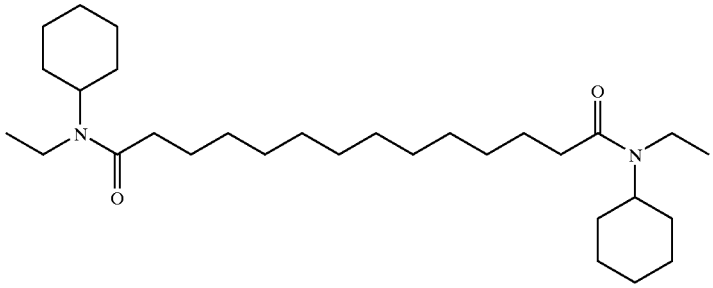
Iz
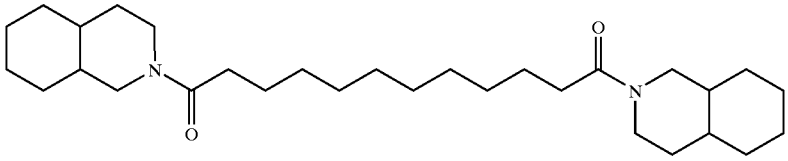

-continued
Iaa
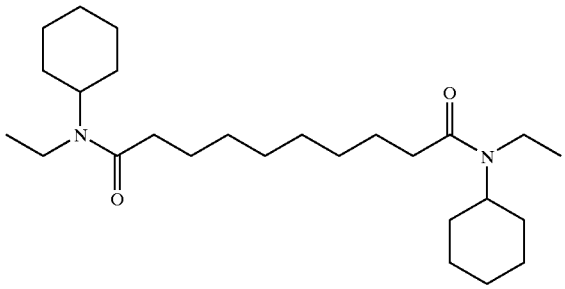
Ibb
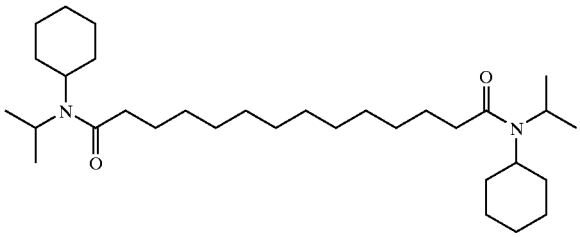
Icc
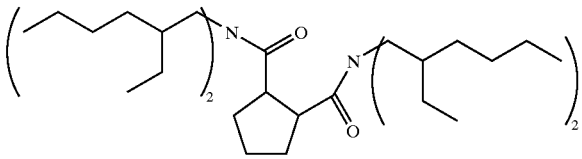
Idd
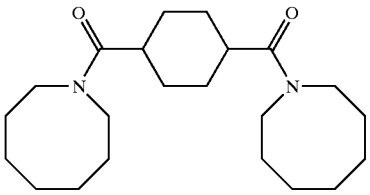
Iee
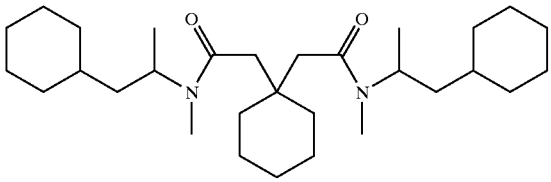
Iff
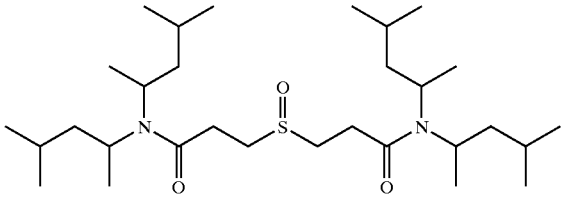
Igg
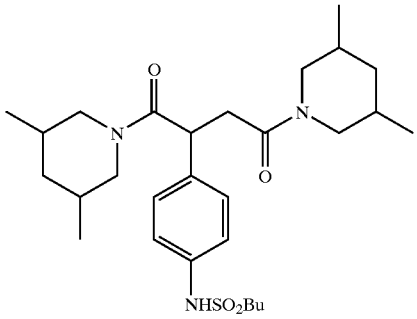
Ihh
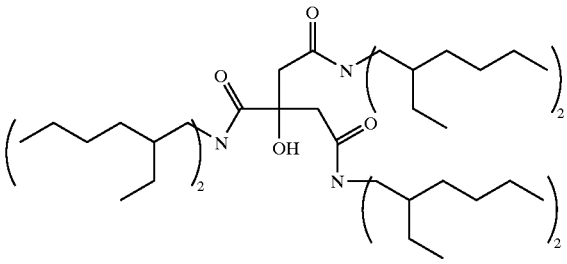
Iii
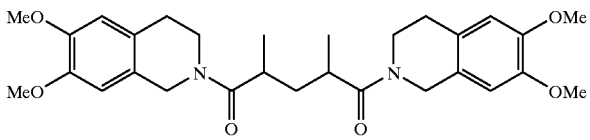
Ijj
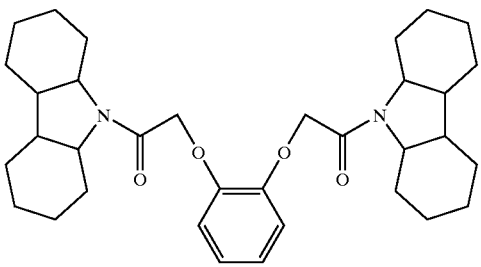
Ikk
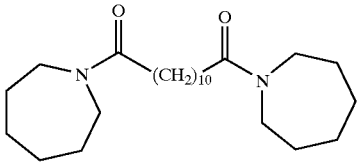
Ill
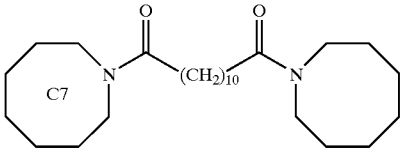

-continued

Imm

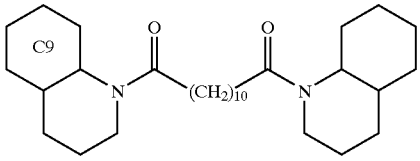

Inn

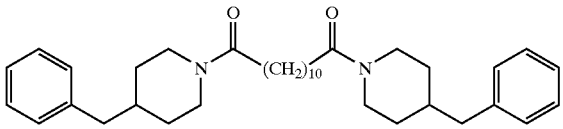

Ioo

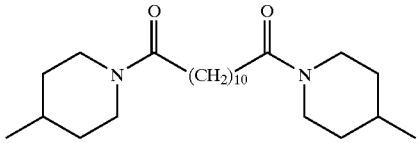

Ipp

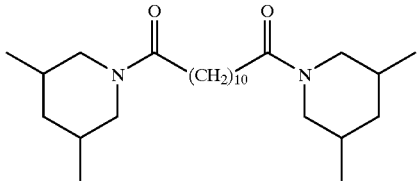

Iqq

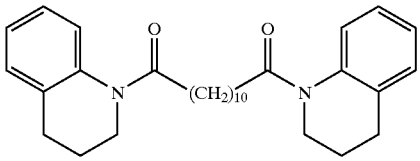

Irr

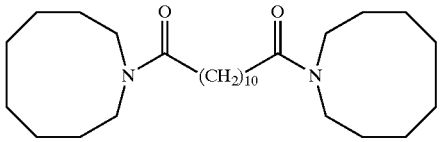

Iss

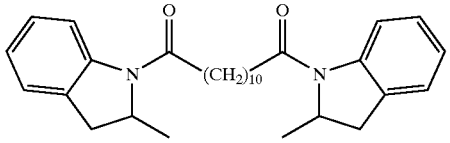

Syntheses of these compounds may use standard procedures. A convenient general reaction scheme which may be used comprises reaction of a diacid chloride of the formula ClC(O)R—C(O)Cl with 2 equivalents of an amine of formula $HNR^1R^2$ in the presence of triethylamine and tetrahydrofuran (or other solvent).

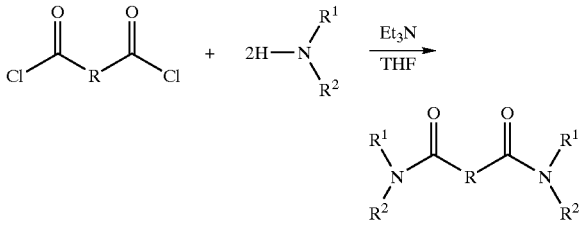

Representative syntheses for compounds which may be used in accordance with the invention are exemplified in the Examples below for compounds Iu and Inn.

In accordance with a preferred embodiment of the present invention, the compounds of Formula I are used in combination with yellow, magenta, or cyan dye-forming couplers, and in particular acetanilide-based yellow dye forming coupler compounds. Such couplers are known compounds and can be prepared by techniques known to those skilled in the art. Individual yellow couplers may be used singly or in combinations. Couplers that form yellow dyes upon reaction with oxidized color developing agent and which are useful in elements of the invention are described, e.g., in such representative patents and publications as: U.S. Pat. Nos. 2,875,057; 2,407,210; 3,265,506; 2,298,443; 3,048,194; 3,447,928 and "Farbkuppler-Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

Typical preferred acetanilide-based yellow couplers are represented by the following formulas:

YELLOW-1

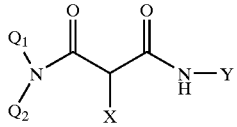

YELLOW-2

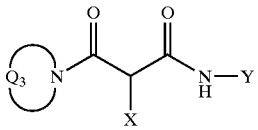

YELLOW-3

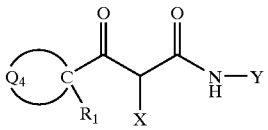

YELLOW-4

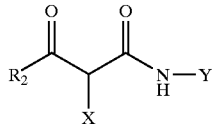

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the illustrated nitrogen atom; and $Q_4$ represents nonmetallic atoms necessary to form a 3- to 5-membered hydrocarbon ring or a 3- to 5-membered heterocyclic ring which contains at least one hetero atom selected from N, O, S, and P in the ring. Preferred couplers are of YELLOW-1 and YELLOW-4 wherein $Q_1$ and $Q_2$ each represent an alkyl group, an aryl group, or a heterocyclic group, and $R_2$ represents an aryl or alkyl group, including cycloalkyl and bridged cycloalkyl groups, and more preferably a tertiary alkyl group. Particularly preferred yellow couplers for use in elements of the invention are represented by YELLOW-4, wherein $R_2$ represents a tertiary alkyl group and Y represents an aryl group, and X represents an aryloxy or N-heterocyclic coupling-off group. The elements of the invention are particularly useful in combination with yellow couplers of the above formulas wherein X represents a nitrogen-containing heterocyclic coupling-off group.

Image dye forming couplers that form magenta dyes upon reaction with oxidized color developing agents may be included in elements of the invention, such as are described in representative patents and publications such as: U.S. Pat. Nos. 2,600,788; 2,369,489; 2,343,703; 2,311,082; 2,908,573; 3,062,653; 3,152,896; 3,519,429 and "Farbkuppler-Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U. K Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent Applications 176,804; 177,765; U.S. Pat. Nos. 4,659,652; 5,066,575; and 5,250,400.

Typical pyrazoloazole and pyrazolone couplers are represented by the following formulas:

MAGENTA-1

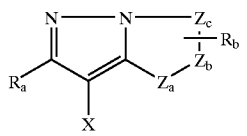

MAGENTA-2

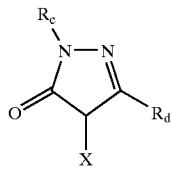

wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon—carbon double bond, it may form part of an aromatic ring, and at least one of $Z_a$, $Z_b$, and $Z_c$ represents a methine group connected to the group $R_b$.

Image dye forming couplers that form cyan dyes upon reaction with oxidized color developing agents may be included in elements of the invention, such as are described in representative patents and publications such as: U.S. Pat. Nos. 2,367,531; 2,423,730; 2,474,293; 2,772,162; 2,895,826; 3,002,836; 3,034,892; 3,041,236; 4,883,746 and "Farbkuppler-Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,096; 570,006; and 574,948.

Typical cyan couplers are represented by the following formulas:

CYAN-1

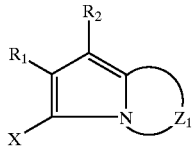

CYAN-2

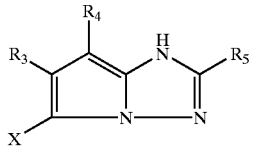

CYAN-3

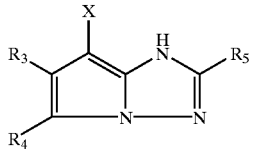

CYAN-4

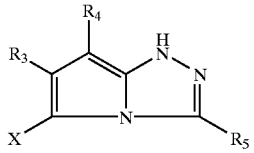

CYAN-5

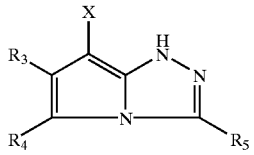

CYAN-6

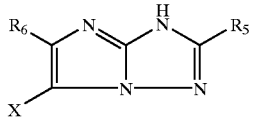

wherein $R_1$ and $R_5$ each represent a hydrogen or a substituent; $R_2$ represents a substituent; $R_3$ and $R_4$ each represent an electron attractive group having a Hammett's substituent constant σpara of 0.2 or more and the sum of the σpara values of $R_3$ and $R_4$ is 0.65 or more; $R_6$ represents an electron attractive group having a Hammett's substituent constant σpara of 0.35 or more; X represents a hydrogen or a coupling-off group; $Z_1$ represents nonmetallic atoms nec essary for forming a nitrogen-containing, six-membered, heterocyclic ring which has at least one dissociative group. A dissociative group has an acidic proton, e.g. —N—, —CH(R)—, etc., that preferably has a pKa value of from 3 to 12 in water. The values for Hammett's substituent constants can be found or measured as is described in the literature. For example, see C. Hansch and A. J. Leo, *J. Med. Chem.,* 16, 1207 (1973); *J. Med. Chem.,* 20, 304 (1977); and J. A. Dean, *Lange's Handbook of Chemistry,* 12th Ed. (1979) (McGraw-Hill).

More preferable are cyan couplers of the following formulas:

CYAN-7

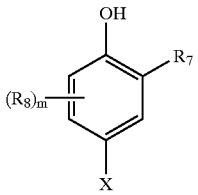

-continued

CYAN-8

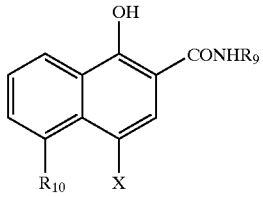

wherein $R_7$ represents a substituent (preferably a carbamoyl, ureido, or carbonamido group); $R_8$ represents a substituent (preferably individually selected from halogen, alkyl, and carbonamido groups); $R_9$ represents a ballast substituent; $R_{10}$ represents a hydrogen or a substituent (preferably a carbonamido or sulphonamido group); X represents a hydrogen or a coupling-off group; and m is from 1–3. Couplers of the structure CYAN-7 are most preferable for use in elements of the invention.

Representative couplers which may be used in the elements of the invention include the following yellow couplers YC1–YC21, magenta couplers MC1–MC17, and cyan couplers CC1—CC17:

YC1

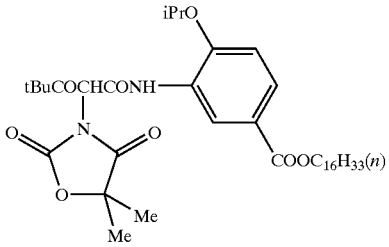

YC2

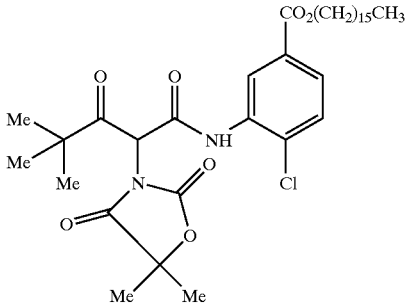

YC4

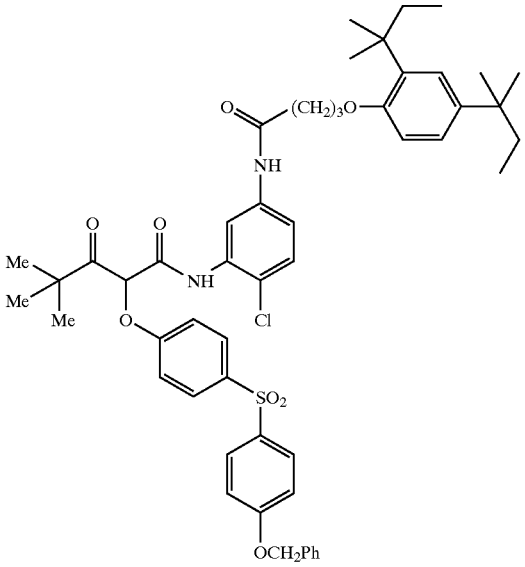

YC3

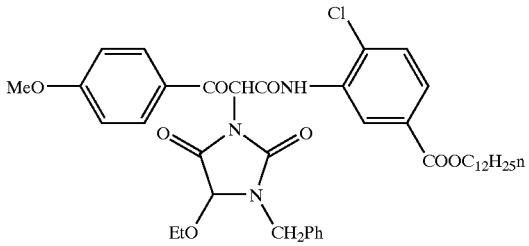

-continued
YC5
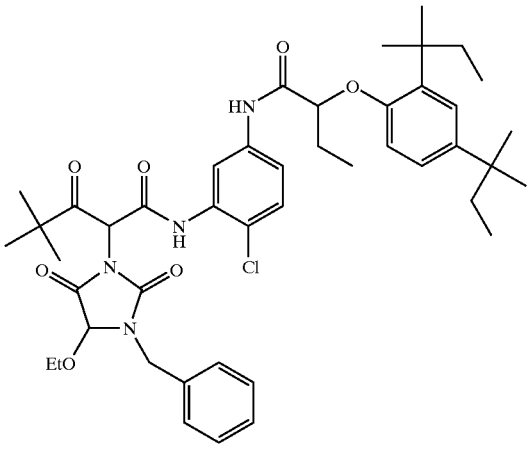
YC6
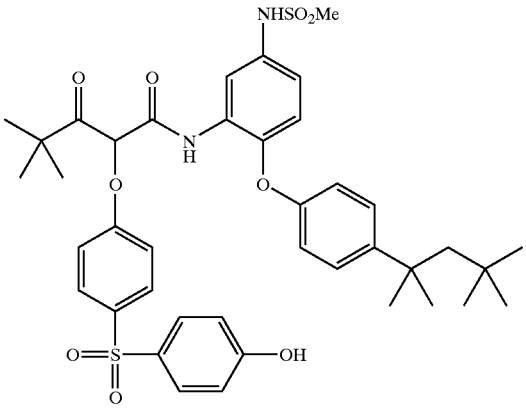
YC7
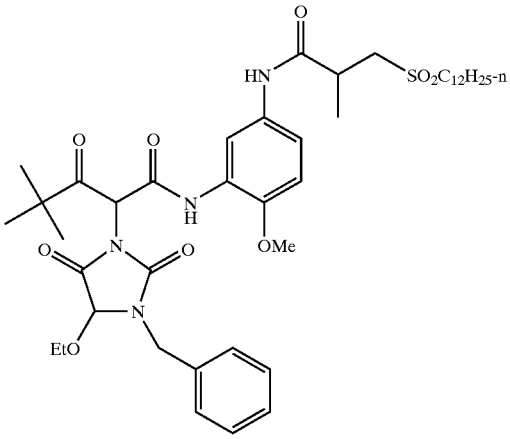
YC8
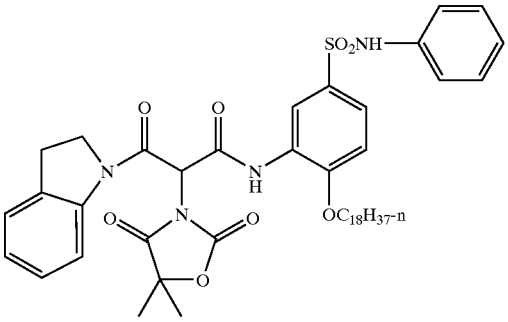
YC9
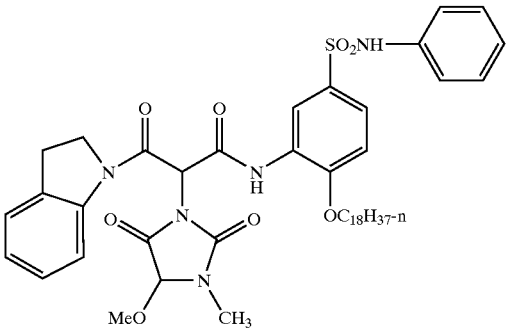
YC10
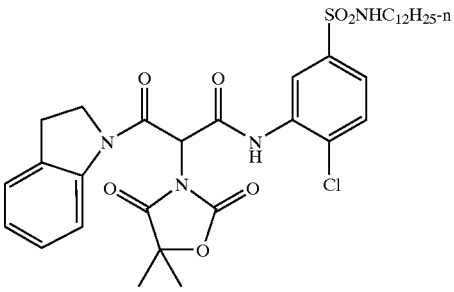
YC11
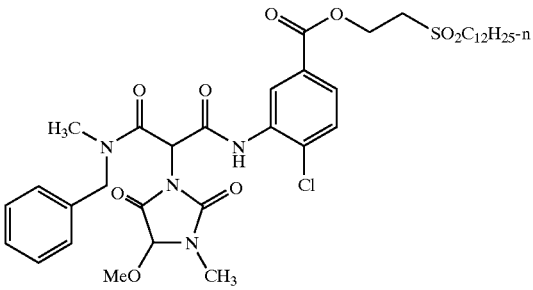
YC12
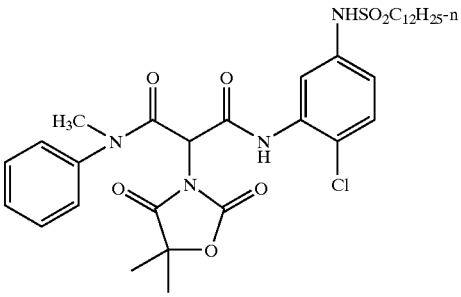

-continued
YC13
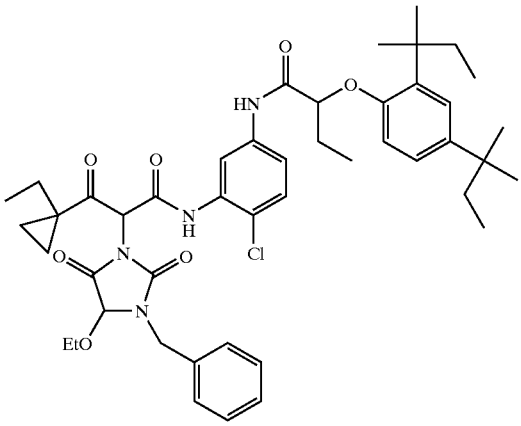
YC14
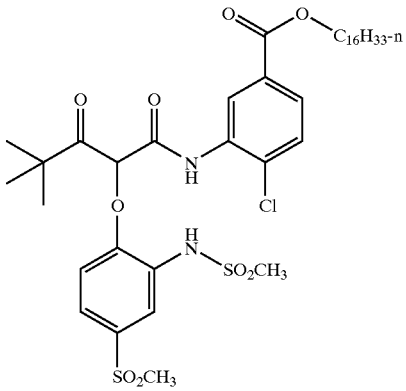
YC15
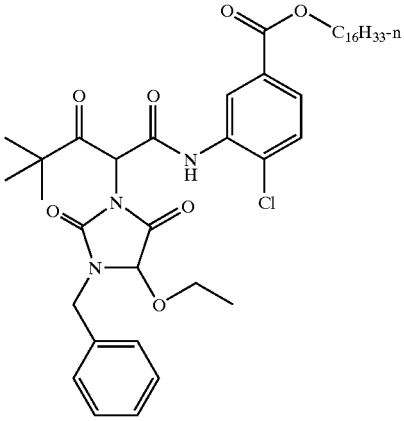
YC16
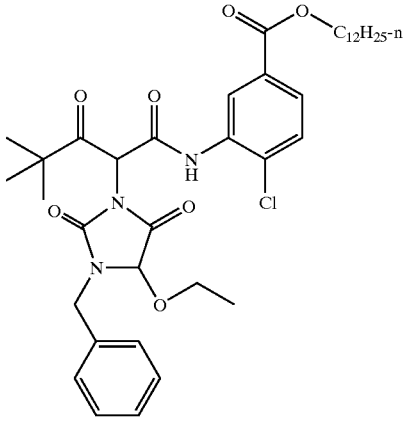
YC17
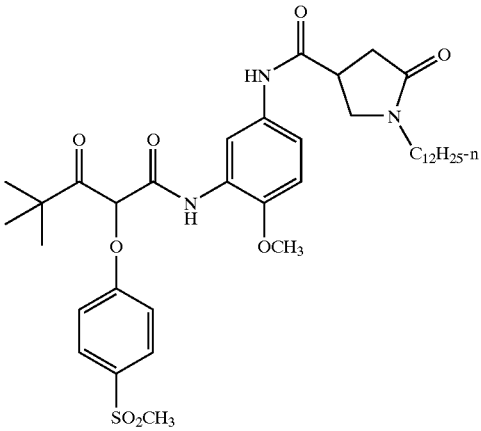
YC18
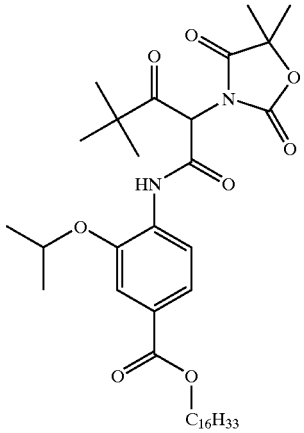

-continued
YC19
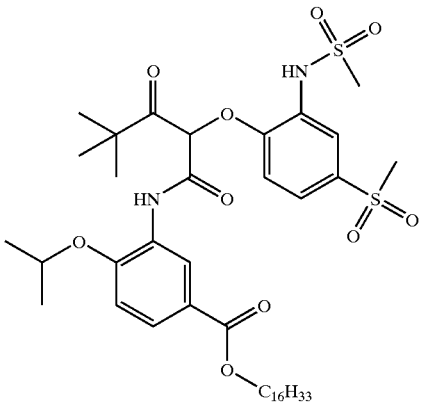
YC20
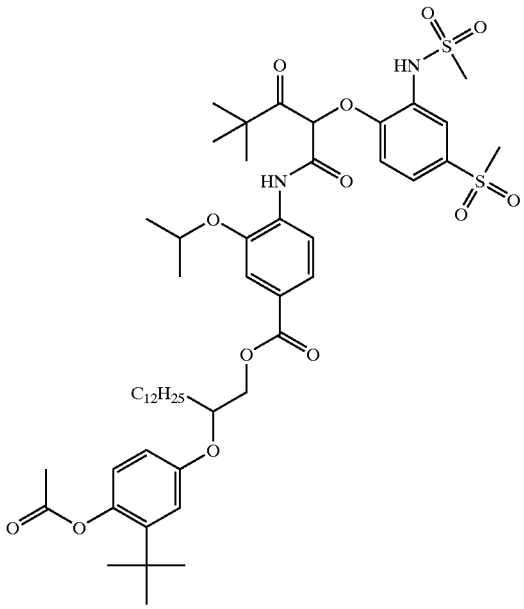
YC21
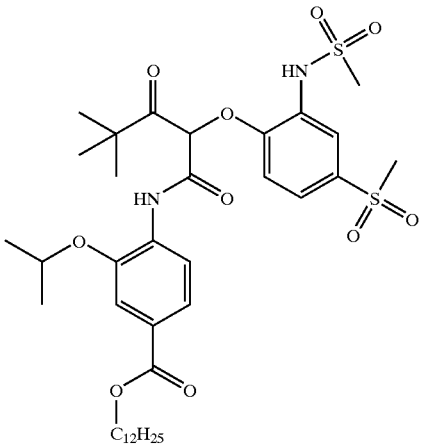
MC1
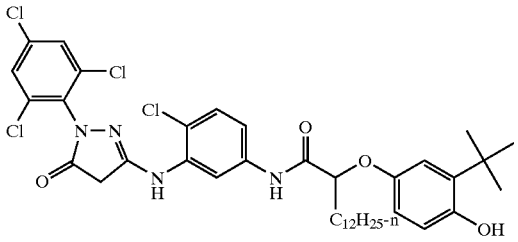
MC2
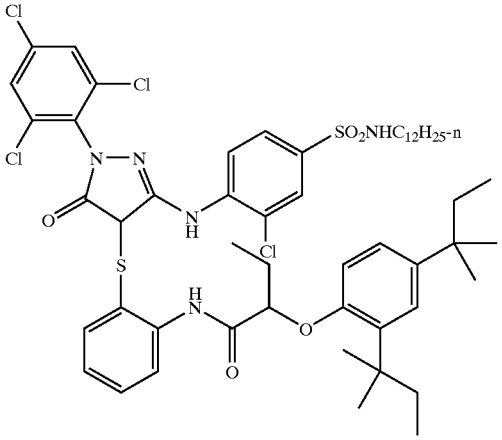
MC3
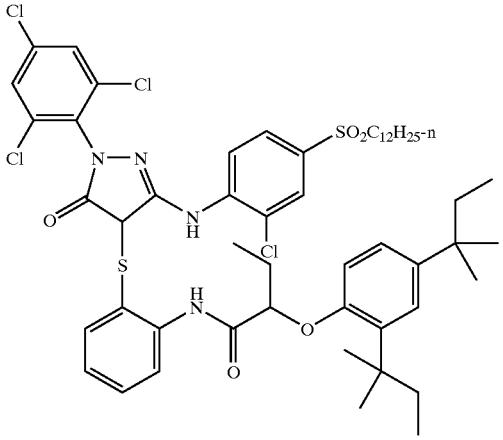

-continued
MC4
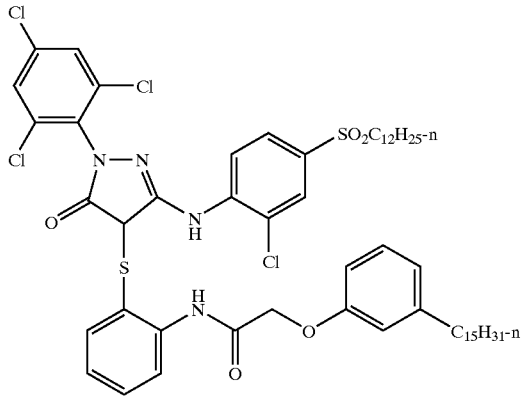
MC5
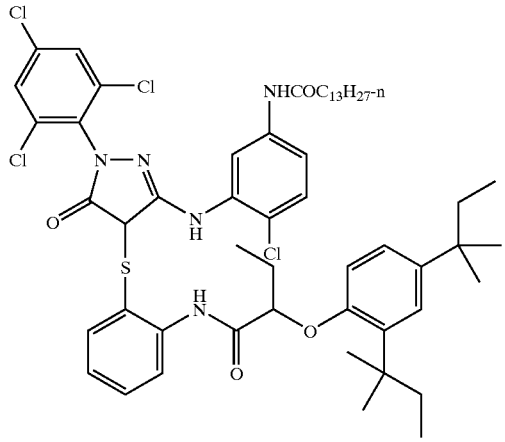
MC6
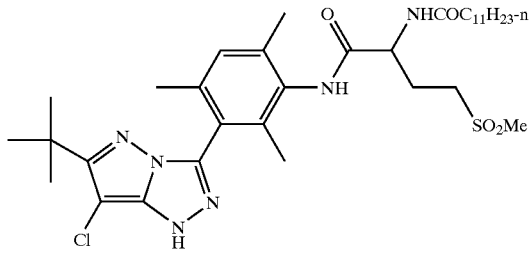
MC7
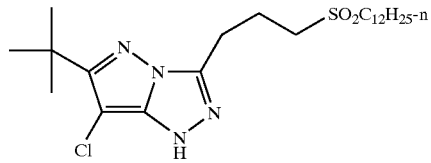
MC8
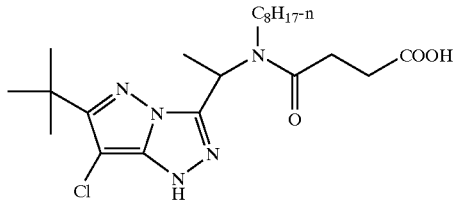
MC9
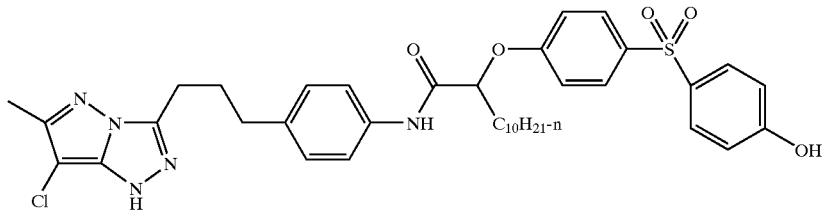
MC10
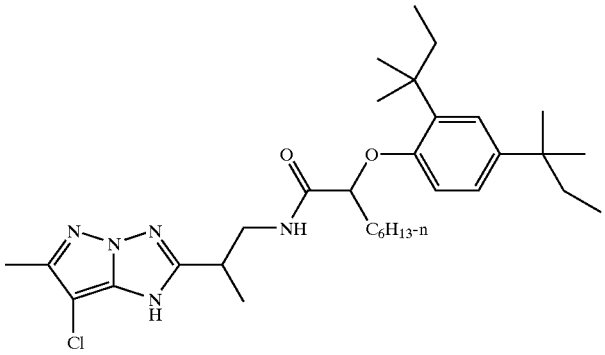

-continued
MC11
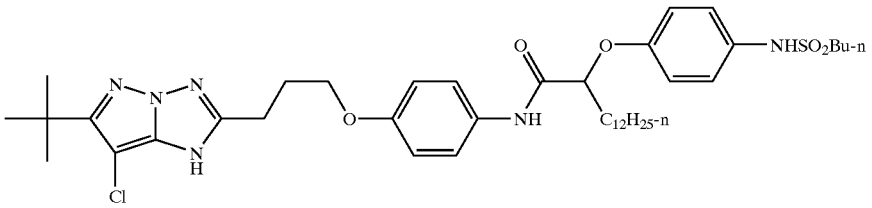
MC12
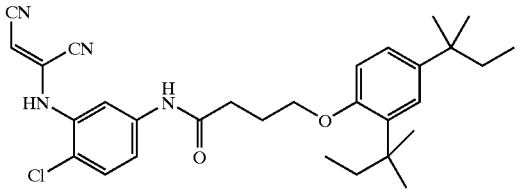
MC13
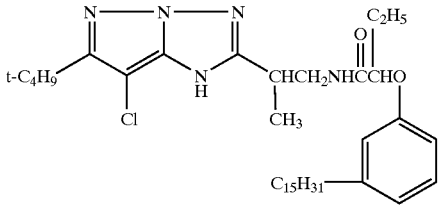
MC14
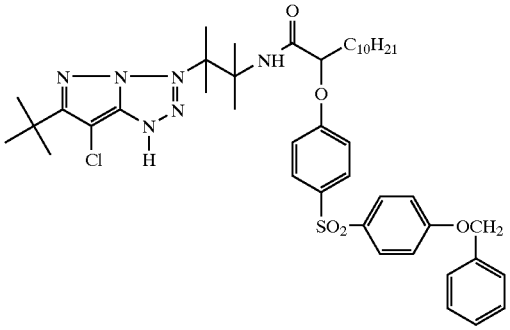
MC15
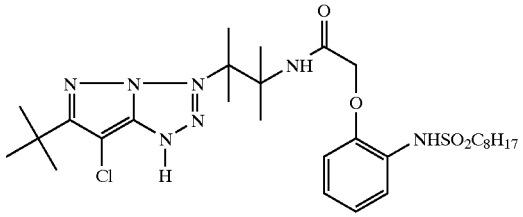
MC16
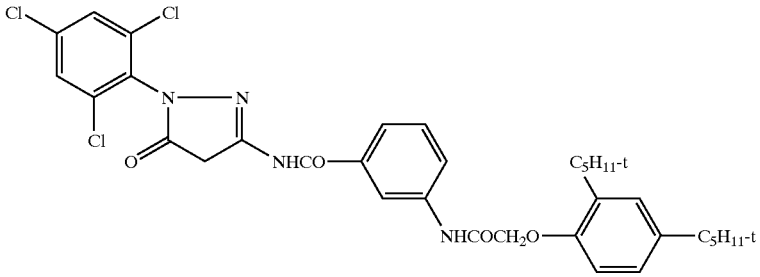
MC17
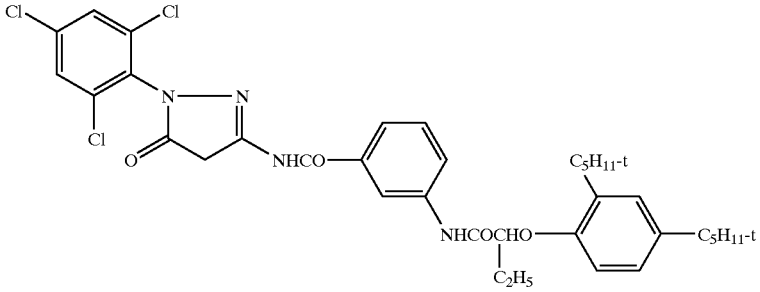

-continued
CC1
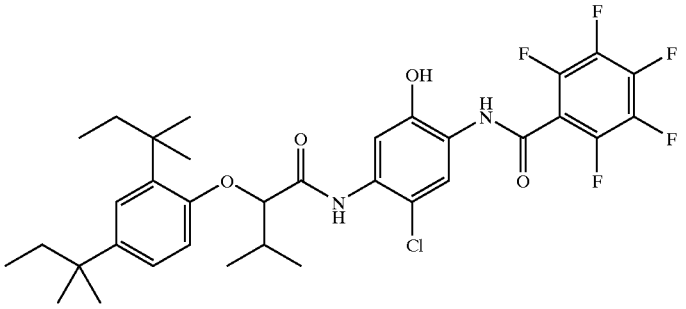
CC2
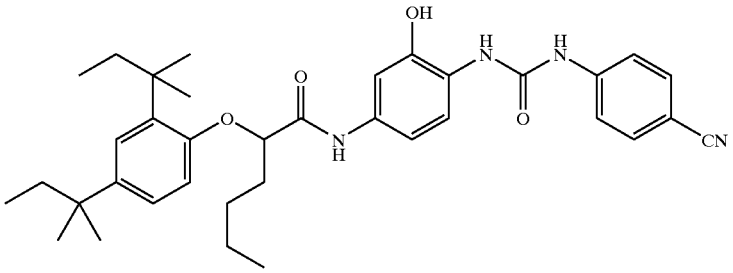
CC3
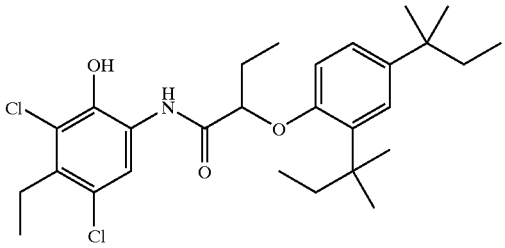
CC4
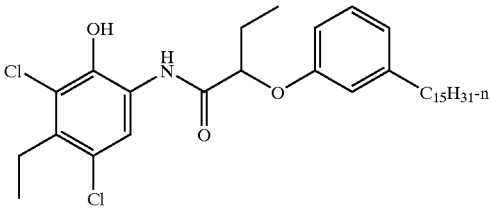
CC5
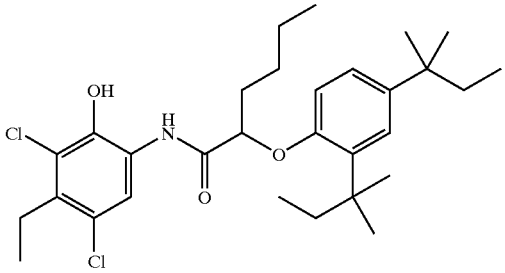
CC6
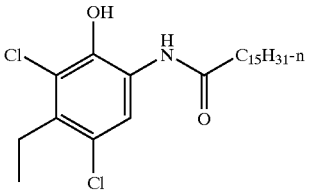
CC7
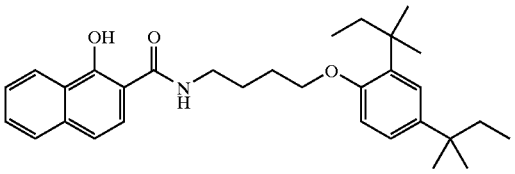
CC8
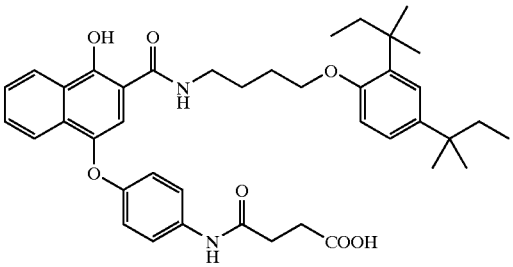
CC9
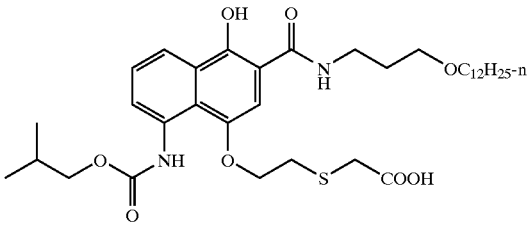
CC10
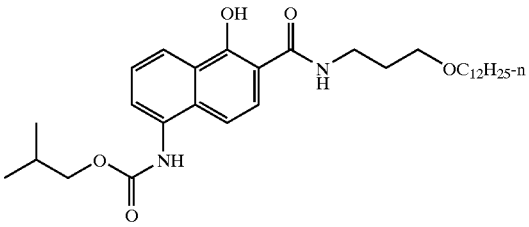

-continued
CC11
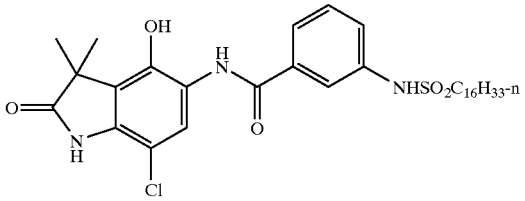
CC12
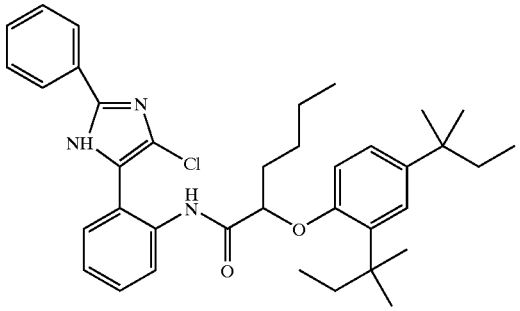
CC13
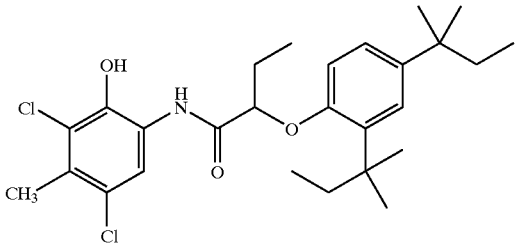
CC14
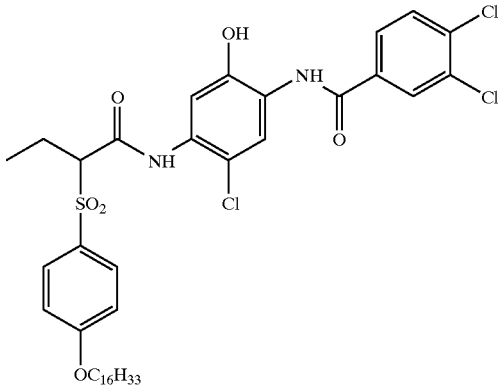
CC15
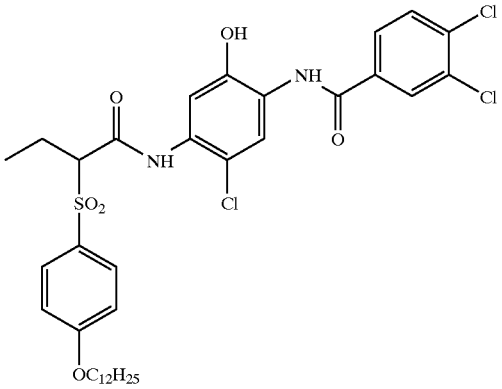
CC16
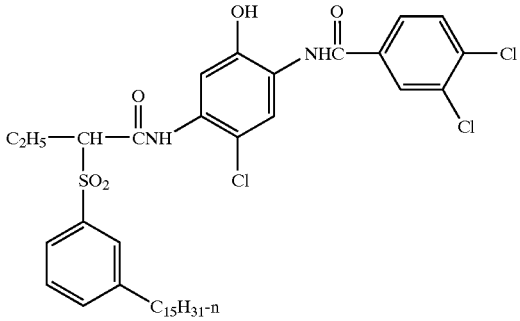
CC17
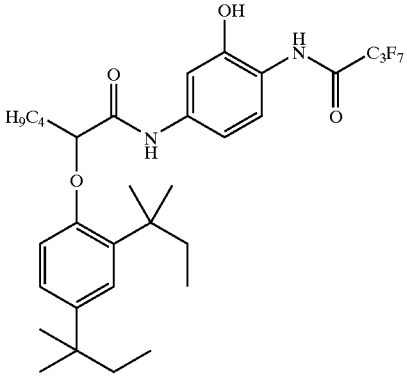

Typically, couplers and the stabilizers with which they are associated are dispersed in the same layer of the photographic element in a permanent high boiling organic compound known in the art as a coupler solvent, either alone or with auxiliary low boiling or water miscible solvents which are removed after dispersion formation. Permanent high boiling solvents have a boiling point sufficiently high, generally above 150° C. at atmospheric pressure, such that they are not evaporated under normal dispersion making and photographic layer coating procedures. Alternatively, the couplers and stabilizers may be dispersed without permanent high boiling solvents using only auxiliary solvent or precipitation techniques as is known in the art. The compounds may be co-dispersed, or may be dispersed separately and then combined. Representative conventional coupler solvents include phthalic acid alkyl esters such as diundecyl phthalate, dibutyl phthalate, bis-2-ethylhexyl phthalate, and dioctyl phthalate, phosphoric acid esters such as tricresyl phosphate, diphenyl phosphate, tris-2-ethylhexyl phosphate, and tris-3,5,5-trimethylhexyl phosphate, citric acid esters such as tributyl acetylcitrate, tributylcitrate and trihexylcitrate, 2-(2-Butoxyethoxy)ethyl acetate, and 1,4-Cyclohexyldimethylene bis(2-ethylhexanoate), benzoic acid esters such as octyl benzoate, aliphatic amides such as N,N-diethyl lauramide, N,N-Diethyldodecanamide, N,N-Dibutyldodecanamide, mono and polyvalent alcohols such as oleyl alcohol and glycerin monooleate, and alkyl phenols such as p-dodecyl phenol and 2,4-di-t-butyl or 2,4-di-t-pentyl phenol. Commonly used coupler solvents are the phthalate esters, which can be used alone or in combination with one another or with other coupler solvents. Selection of the particular coupler solvent has been found to have an influence on the activity of the coupler as well as the hue and stability of the dye formed on coupling. In accordance with certain embodiments, the compounds of Formula I may be advantageously used to partly or totally replace conventional high boiling solvents in dispersing the dye-forming couplers in the photographic elements of the invention.

Typically the amount of compound I used will range from about 0.05 to about 4.0 moles per mole of coupler, preferably from about 0.1 to 2.5 moles per mole of coupler. The coupler is typically coated in the element at a coverage of from 0.25 mmol/$m^2$ to 2.0 mmol/$m^2$, and preferably at a coverage of from 0.40 to 1.2 mmol/$m^2$. When used as a permanent coupler solvent, compounds of formula I will typically be employed in an amount of 0.1 to 5.0 mg/mg coupler, and preferably in an amount of 0.25 to 2.0 mg/mg coupler.

To further enhance the stability of the dyes formed in photographic elements in accordance with the invention, additional conventional stabilizing compounds may also be included. In accordance with a particularly preferred embodiment, the use of compounds of Formula I in combination with conventional phenolic and bisphenolic yellow dye stabilizers, and in particular substituted bisphenol based stabilizers, have been found to unexpectedly provide beneficial yellow formed dye light stability.

Substituted bisphenol light stabilizer compounds which may be used in accordance with preferred embodiments of the invention generally comprise bisphenol derivatives having two linked phenol rings wherein at least one of the phenol rings is substituted as described in the references cited above. Preferably, at least one of the phenolic hydroxy groups is also substituted with a blocking group. Such preferred blocked bisphenolic compounds are preferably of the following Formula II:

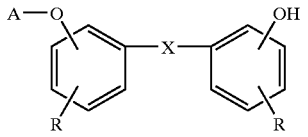

wherein A represents an alkyl (e.g., methyl, ethyl, propyl or butyl), cycloalkyl (e.g., cyclohexyl), alkenyl, aryl (e.g., phenyl), acyl (e.g., acetyl or benzoyl), alkylsulfonyl or arylsulfonyl substituent group, X represents a single bond or a bivalent linking group (e.g., an alkylidene group such as methyline, butylidine, or 3,3,5-trimethylhexylidene, or a heteroatom such as oxygen, sulfur, selenium, or tellurium, or a sulfonyl or phosphinyl group), and each R independently represents one or more alkyl, alkenyl, cycloalkyl, or aryl substituent group, such as described for A above, or in combination with the benzene ring to which it is attached represents the atoms necessary to complete a fused ring system. Each A, X and R substituent or linking group may be further substituted or unsubstituted. Specific examples of such blocked bisphenolic compounds, along with synthesis techniques, are disclosed, e.g., in U.S. Pat. Nos. 4,782,011 and 5,426,021, the disclosures of which are incorporated herein by reference. Additional substituted phenolic stabilizers which may be advantageously used in combination with the invention include those described in U.S. Pat. Nos. 5,091,294, 5,284,742, 5,935,773 and EP 0 310 551 and EP 0 310 552. When used in combination with compounds of the Formula I, the substituted phenolic stabilizers may be used at similar concentrations. Preferably, the molar ratio of compound of Formula I to substituted phenolic light stabilizer compound is from 1:12 to 25:1. The compounds of Formula I may also be used in combination with thiomorpholine compounds as described in EP 1 116 997. While it is an advantage of the invention that improved light stability may obviate the need for polymeric latex materials as light stabilizers, they may also be incorporated if desired. Specifically, the polymer latex materials as described in U.S. Pat. No. 5,981,159 may be employed.

To obtain a satisfactory color and tonal balance as photographic images fade on exposure to light, it is important to achieve a balanced rate of density loss from yellow, magenta and cyan dyes. It is particularly desirable to produce a balanced rate of yellow and magenta dye loss in order to maintain a pleasing reproduction of skin tones. In accordance with preferred embodiments of the invention, a balanced rate of fade can be achieved using a yellow dye-forming layer comprising a stabilizer combination in accordance with preferred embodiments of this invention in combination with a magenta dye-forming coupler layer comprising highly-stable pyrazolotriazole coupler.

The yellow, cyan and magenta dye forming couplers that may be used in the elements of the invention can be defined as being 4-equivalent or 2-equivalent depending on the number of atoms of $Ag^+$ required to form one molecule of dye. A 4-equivalent coupler can generally be converted into a 2-equivalent coupler by replacing a hydrogen at the coupling site with a different coupling-off group. Coupling-off groups are well known in the art. Such groups can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169; 3,227,551; 3,432,521; 3,476,563; 3,617,291; 3,880,661; 4,052,212 and 4,134,766; and in U.K. Patents and published Application Nos. 1,466,728; 1,531,927; 1,533,039; 2,006,755A and 2,017,704A.

To control the migration of various components coated in a photographic layer, including couplers, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to polymeric backbone.

Photographic elements of this invention can have the structures and components described in an article titled "Typical and Preferred Color Paper, Color Negative, and Color Reversal Photographic Elements and Processing," published in Research Disclosure, February 1995, Item 37038, pages 79–114. Research Disclosure is published by Kenneth Mason Publications, Ltd., Dudley Annex, 12a North Street, Emsworth, Hampshire P010 7DQ, ENGLAND. A typical multicolor photographic element of this invention comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective. In a preferred embodiment, the invention is directed towards a photographic element that may be displayed for extended periods under illuminated conditions, such as a color paper photographic element which comprises photographic layers coated on a reflective support. Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523.

While the order of the color sensitive layers in a photographic element in accordance with various embodiments of the invention can be varied, they will normally be red-sensitive, green-sensitive and blue-sensitive, in that order on a transparent support, (that is, blue sensitive furthest from the support) and the reverse order on a reflective support being typical. The element typically will have a total thickness (excluding the support) of from 5 to 30 microns.

This invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*, September 1994, Number 365, Item 36544, which will be identified hereafter by the term "Research Disclosure I." The Sections hereafter referred to are Sections of the Research Disclosure I.

The silver halide emulsions employed in the elements of this invention can be either negative-working, such as surface-sensitive emulsions or unfogged internal latent image forming emulsions, or direct positive emulsions of the unfogged, internal latent image forming type which are positive working when development is conducted with uniform light exposure or in the presence of a nucleating agent. Suitable emulsions and their preparation as well as methods of chemical and spectral sensitization are described in Sections I through V. Color materials and development modifiers are described in Sections V through XX. Vehicles which can be used in the elements of the present invention are described in Section II, and various additives such as brighteners, antifoggants, stabilizers, light absorbing and scattering materials, hardeners, coating aids, plasticizers, lubricants and matting agents are described, for example, in Sections VI through X and XI through XIV. Manufacturing methods are described in all of the sections, other layers and supports in Sections XI and XIV, processing methods and agents in Sections XIX and XX, and exposure alternatives in Section XVI.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S.

Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as developer inhibitor releasing compounds (DIR's).

The elements of the present invention may be employed to obtain reflection color prints as described in *Research Disclosure*, November 1979, Item 18716, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed in Japanese Published Patent Applications 83/09,959; 83/62,586; 90/072,629, 90/072,630; 90/072,632; 90/072,633; 90/072,634; 90/077,822; 90/078,229; 90/078,230; 90/079,336; 90/079,338; 90/079,690; 90/079,691; 90/080,487; 90/080,489; 90/080,490; 90/080,491; 90/080,492; 90/080,494; 90/085,928; 90/086,669; 90/086,670; 90/087,361; 90/087,362; 90/087,363; 90/087,364; 90/088,096; 90/088,097; 90/093,662; 90/093,663; 90/093,664; 90/093,665; 90/093,666; 90/093,668; 90/094,055; 90/094,056; 90/101,937; 90/103,409; 90/151,577.

The silver halide emulsion grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 to 80° C., as illustrated in *Research Disclosure*, June 1975, item 13452 and U.S. Pat. No. 3,772,031.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process,* 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog unexposed silver halide (usually chemical or light fogging), followed by treatment with a color developer. Preferred color developing agents are p-phenylenediamines. Especially preferred are: 4-amino-N,N-diethylaniline hydrochloride, 4-amino-3-methyl-N,N-diethylaniline hydrochloride, 4-amino-3-methyl-N-ethyl-N-(b-(methanesulfonamido) ethylaniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying. Bleaching and fixing can be performed with any of the materials known to be used for that purpose. Bleach baths generally comprise an aqueous solution of an oxidizing agent such as water soluble salts and complexes of iron (III)(e.g., potassium ferricyanide, ferric chloride, ammonium or potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

The photographic elements comprising stabilizers in accordance with this invention may be processed in amplification processes that use developer/amplifier solutions described in U.S. Pat. No. 5,324,624, for example. When processed in this way, the low volume, thin tank processing system and apparatus described in U.S. Pat. No. 5,436,118 preferably is employed.

EXAMPLES

Synthesis Examples

Iu: Triethylamine (7.95 g; 78.5 mmol) and di-sec-butylamine (9.9 g; 76.7 mmol) were dissolved in THF (300 mL) and cooled in an ice bath. Dodecanedioyl dichloride (10 g; 37.4 mmol) dissolved in THF (100 mL) was added drop wise and the heterogeneous mixture was allowed to warm to room temperature and stir over night. The white salts were removed by filtration and the salts washed with THF. Most of the THF was removed from the filtrate under vacuum and the resulting solution was poured into 1.8L of dilute HCl/ice water. The solution was extracted with dichloromethane (2×'s) and the combined organic layers were dried ($Na_2SO_4$). Solvent removal under vacuum afforded 16.9 g of a pale yellow oil. Chromatography on silica gel with 96:4; dichloromethane:acetone afforded 10.5 g (62%) of the desired material (Iu) as a very pale yellow oil. MS, m/e=453 (P+1) in $ES^+$ mode.

Inn: Triethylamine (39.8 g; 393 mmol) and 4-benzylpiperidine (67.24 g; 384 mmol) were dissolved in THF (1L) and stirred at room temperature. Dodecanedioyl dichloride (50 g; 187 mmol) dissolved in THF (250 mL) was added drop wise (slightly exothermic) and the heterogeneous white mixture was stirred at room temperature over night. The salts were removed by filtration and washed with THF (2×'s). Most of the THF was removed from the filtrate under vacuum. The remaining liquid was poured into 2L of dilute HCl/ice water and stirred over night. Filtration afforded a while solid that was washed with water and air dried to give 100.5 g. This material was passed through a slug of silica gel with 1:1; ethylacetate:heptane. The resultant solid was stirred in hexane and filtered to afford 80 g (78.5%) of the desired product (Inn) as a white solid. MS, m/e=545 (P+1) in $ES^+$ mode. Mp. 51–52° C.

Photographic Examples

The following photographic examples further illustrate this invention. In such examples, coupler of the above structure YC-2 is employed. Also, in addition to various compounds of Formula I above and comparison solvents, stabilizers YSt-1 through YSt-3 are employed:

YSt-1

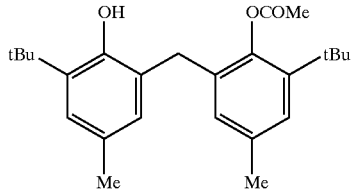

-continued

YSt-2

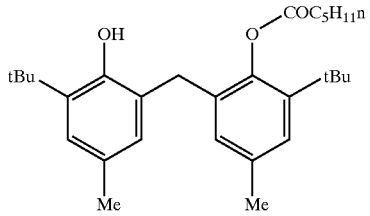

YSt-3

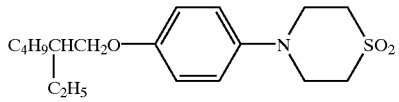

Coupler dispersions were prepared in accordance with conventional techniques by dissolving coupler YC2 in an equal weight of various comparison solvents or compounds in accordance with the invention with heating. Stabilizers YSt-1, YSt-2, and YSt-3 were added to the yellow coupler oil phase (to provide indicated coated coverages), and the oil phase was dispersed in an aqueous phase containing gelatin and surfactant Alkanol-XC by homogenizing the mixture in a colloid mill. Each of the coupler dispersions was mixed with a blue-sensitive cubic silver chloride photographic emulsion for coating on a resin-coated paper support, pre-coated with an unhardened gel pad. The coating structure is shown below.

| Coating Structure | |
|---|---|
| GEL SUPERCOAT | |
| Gelatin | 1.4 g · $m^{-2}$ |
| Hardener* | 0.15 g · $m^{-2}$ |
| Coating Surfactants | |
| PHOTOSENSITIVE LAYER | |
| Gelatin | 2.15 g · $m^{-2}$ |
| Coupler | 5.93 × $10^{-4}$ mol/$m^2$ |
| Coupler Solvent | equal to weight of coupler |
| YSt-1 | 0.0538 g · $m^{-2}$ |
| Yst-2 | 0.0086 g · $m^{-2}$ |
| Yst-3 | 0.0538 g · $m^{-2}$ |
| Ag Halide emulsion | 0.210 g · $m^{-2}$ (as Ag) |
| GEL PAD | |
| Gelatin | 3.230 g · $m^{-2}$ |
| Resin Coated Paper | |

*Hardener = bis(vinylsulphonylmethane)

Comparison coupler solvents Ca—Cf used in the examples are the following:

Ca

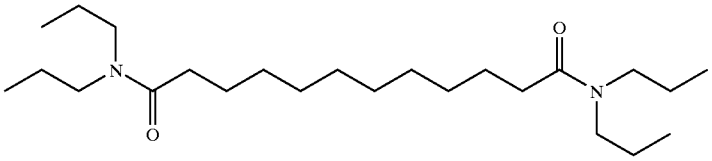

Cb

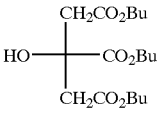

Cc

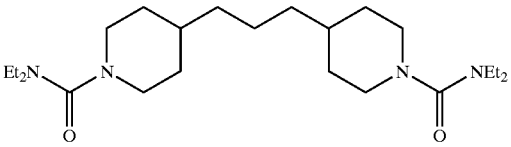

Cd

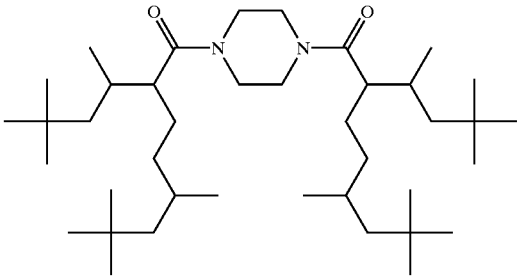

Ce

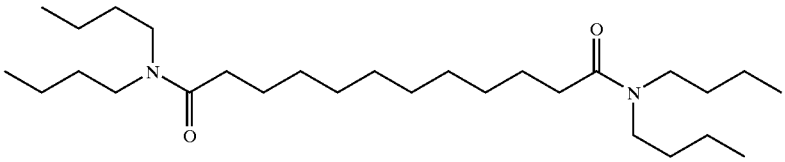

Cf

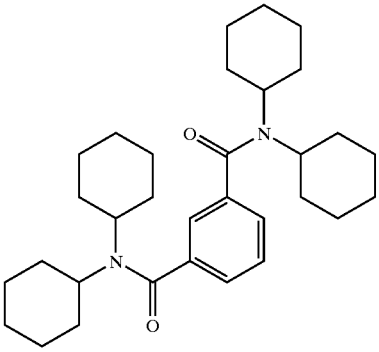

Sample strips of the coatings were exposed to blue light through a step tablet (density range 0–3, 0.15 increments) and developed in standard Kodak RA4 processing solutions before washing and drying. Sensitometric curves were generated for each processed strip. The image dye light stability was assessed using simulated daylight fading equipment incorporating a rotating Xenon arc light source surrounded by window glass, delivering an exposure intensity of 50 Klux at the sample plane. Prior to fade testing, the samples were covered with a clear acetate film with UV-absorbing dye coating. At the end of these tests, the densities of the sample strips were re-measured and compared with the initial curves. Status "A" blue density changes from an initial density value of 1.0 after 3 weeks treatment are recorded in the Tables below.

Photographic Example 1

To demonstrate the effect of branching in amide substituent groups for compounds in accordance with Formula I, coupler dispersion and coatings were made as described above for comparison solvent Ca (comprising straight chain (n-propyl) groups) and solvents In (comprising branched (isopropyl) groups) and Ioo (comprising joined ring groups) in accordance with Formula I, as well as for comparison solvent Ce (comprising straight chain (n-butyl) groups) and solvents Iu (comprising branched (sec-butyl) groups) and Ix (comprising cyclic ring groups). In each case the comparison and corresponding invention examples employed solvents comprising the same number of carbon atoms. The results are reported in Table 1.

TABLE 1

| Coupler solvents | 3 week HID % loss from D = 1 |
|---|---|
| Ca (straight chain) | 60.1% |
| In | 22.5% |
| Ioo | 26.9% |
| Ce (straight chain) | 57.9% |
| Iu | 25.2% |
| Ix | 17% |

Use of compounds in accordance with the invention provided a significant advantage over the comparisons.

Photographic Example 2

To demonstrate the light stabilizing effect of compounds in accordance with Formula I relative to a conventional prior art coupler solvent, another set of coupler dispersions and coatings were made as described above for comparison solvent Cb (tributylcitrate) and solvents Ib, Ic, Ie, If, and Ij in accordance with Formula I. The results are reported in Table 2.

TABLE 2

| Coupler solvents | 3 week HID % loss from D = 1 |
|---|---|
| Cb (TBC) | 52% |
| Ib | 21% |
| Ic | 22% |
| Ie | 22% |
| If | 16% |
| Ij | 12% |

As in Example 1, use of compounds of Formula I in accordance with the invention showed greatly improved light stability relative to use of the comparison solvent.

Photographic Example 3

To demonstrate the enhanced light stabilizing effect of compounds of Formula I wherein at least one of the $R^1$, $R^2$, $R^3$ or $R^4$ groups comprises a cyclic group in accordance with preferred embodiments of the invention, another set of coupler dispersions and coatings were made as described above for solvents In, Iu, and Ij in accordance with Formula I. The results are reported in Table 3.

TABLE 3

| Coupler solvents | 3 week HID % loss from D = 1 |
|---|---|
| In | 21% |
| Iu | 22% |
| Ij (cyclohexyl) | 11% |

While all three compounds provided good light stability, the use of compound Ij (wherein two of the $R^1$, $R^2$, $R^3$ and $R^4$ groups comprise cyclohexyl groups) was found to be particularly effective.

Photographic Example 4

To demonstrate the light stabilizing effect of compounds in accordance with Formula I relative to additional comparison compounds, another set of coupler dispersions and coatings were made as described above for comparison solvents Cb (tributylcitrate), Cc (bis-urea), Cd, and Cf and solvents Ij, Iz, Imm, and Inn in accordance with Formula I. The results are reported in Table 4.

TABLE 4

| Coupler solvents | 3 week HID % loss from D = 1 |
|---|---|
| Cb (TBC) | 56.0% |
| Cc (bis-urea) | 12.0% |
| Cd | 22.0% |
| Cf | 15.6% |
| Ij (invention) | 11.0% |
| Iz (invention) | 7.1% |
| Imm (invention) | 8.4% |
| Inn (invention) | 6.4% |

Use of compounds in accordance with the invention again demonstrated performance equal to or better than the comparison compounds. The compounds of Formula I additionally are advantaged relative to comparison compounds Cc and Cd in that such comparison compounds are relatively more difficult and/or more expensive to produce.

Photographic Example 5

As demonstrated in the above examples, use of compounds in accordance with the invention provides desired light stability. To demonstrate the effect of compounds in accordance with Formula I on maximum density relative to a conventional prior art coupler solvent, another set of coupler dispersions and coatings were made as described above for comparison solvent Cb (tributylcitrate) and solvents Ii, Ij, In, and Iy in accordance with Formula I. The results are reported in Table 5.

TABLE 5

| Coupler solvents | Dmax |
|---|---|
| Cb | 2.393 |
| Ii | 2.531 |
| Ij | 2.488 |
| In | 2.56 |
| Iy | 2.514 |

se of compounds in accordance with the invention resulted in increased Dmax, demonstrating improved activity relative to the comparison coupler solvent.

The invention has been described by reference to preferred embodiment, but it will be understood changes can be made to the embodiments specifically described herein within the spirit and scope of the invention.

What is claimed is:

1. A photographic element comprising a silver halide emulsion layer having associated therewith a dye forming coupler and a compound of the following Formula I:

$$R^1R^2N—C(O)—(R)_p—C(O)—NR^3R^4$$

wherein R represents a non-aromatic hydrocarbon linking group; p=1; and each of $R^1$, $R^2$, $R^3$ and $R^4$ independently represents an aromatic, cyclic, linear or branched chain hydrocarbon group; with the proviso (i) at least two of $R^1$, $R^2$, $R^3$ and $R^4$ comprises cyclic, secondary, or otherwise branched chain alkyl hydrocarbon group.

2. An element according to claim 1, wherein each of $R^1$, $R^2$, $R^3$ and $R^4$ is independently a hydrocarbon group of from 1 to 22 carbon atom.

3. An element according to claim 2, wherein $R^3$ and $R^4$ are selected to match $R^1$ and $R^2$.

4. An element according to claim 2, wherein at least two of $R^1$, $R^2$, $R^3$ and $R^4$ comprise cyclic alkyl groups.

5. An element according to claim 2, wherein each of $R^1$, $R^2$, $R^3$ and $R^4$ comprise cyclic, secondary, or otherwise branched chain alkyl groups.

6. An element according to claim 1, wherein R comprises a cyclic, linear, or branched chain linking group comprising from 1 to 30 carbon atoms.

7. An element according to claim 6, wherein R represents a $C_1$–$C_{30}$ alkylene linking group.

8. An element according to claim 6, wherein R represents a $C_1$–$C_{16}$ alkylene linking group.

9. An element according to claim 1, wherein the dye-forming coupler comprises an acetanilide-based yellow dye-forming coupler.

10. An element according to claim 9, wherein the yellow coupler is of the formula

YELLOW-1

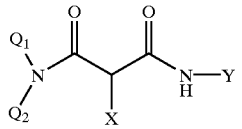

YELLOW-2

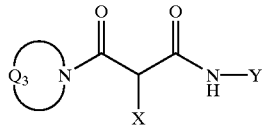

YELLOW-3

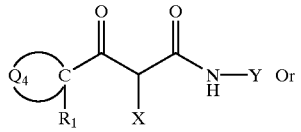

YELLOW-4

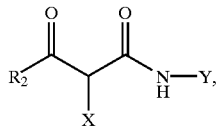

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the illustrated nitrogen atom; and $Q_4$ represents nonmetallic atoms necessary to form a 3- to 5-membered hydrocarbon ring or a 3- to 5-membered heterocyclic ring which contains at least one hetero atom selected from N, O, S, and P in the ring.

11. An element according to claim 10, wherein the yellow coupler is of the formula YELLOW-4 where $R_2$ represents an aryl or alkyl group and Y represents an aryl group.

12. An element according to claim 11, wherein $R_2$ represents a tertiary alkyl group.

13. An element according to claim 9, wherein the molar ratio of compound of formula I to yellow coupler is from 0.05:1 to 4.0:1.

14. An element according to claim 9, wherein the silver halide emulsion layer further has associated therewith a substituted phenolic light stabilizer compound.

15. An element according to claim 9, comprising a color paper photographic element which comprises a reflective support.

16. An element according to claim 9, wherein the compound of formula I is employed as a permanent coupler solvent in an amount of from 0.1 to 5.0 mg/mg yellow coupler.

17. An element according to claim 1, comprising a color paper photographic element which comprises a reflective support.

18. An element according to claim 1, wherein the molar ratio of compound of formula I to coupler is from 0.05:1 to 4.0:1.

19. An element according to claim 1, wherein the compound of formula I is employed as a permanent coupler solvent in an amount of from 0.1 to 5.0 mg/mg dye-forming coupler.

* * * * *